US007673604B2

(12) United States Patent
Takane et al.

(10) Patent No.: US 7,673,604 B2
(45) Date of Patent: Mar. 9, 2010

(54) ENGINE

(75) Inventors: Yoshikazu Takane, Shizuoka-ken (JP); Minoru Akahori, Shizuoka-ken (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 405 days.

(21) Appl. No.: 11/719,644

(22) PCT Filed: Nov. 21, 2005

(86) PCT No.: PCT/JP2005/021367

§ 371 (c)(1), (2), (4) Date: May 17, 2007

(87) PCT Pub. No.: WO2006/054743

PCT Pub. Date: May 26, 2006

(65) Prior Publication Data

US 2009/0145387 A1 Jun. 11, 2009

(30) Foreign Application Priority Data

Nov. 19, 2004 (JP) ..... 2004-335549

(51) Int. Cl.
*F01M 1/06* (2006.01)

(52) U.S. Cl. ..... 123/90.34; 123/90.33; 123/90.48

(58) Field of Classification Search ..... 123/90.33, 123/90.34, 90.48
See application file for complete search history.

(56) References Cited

U.S. PATENT DOCUMENTS 6,338,324 B1 * 1/2002 Tanaka et al. ..... 123/90.34

FOREIGN PATENT DOCUMENTS

| | | |
|---|---|---|
| JP | 3-54217 | 5/1991 |
| JP | 5-42616 | 6/1993 |
| JP | 7-30305 | 6/1995 |
| JP | 09-170416 | 6/1997 |
| JP | 2001-090527 | 4/2001 |

* cited by examiner

*Primary Examiner*—Zelalem Eshete
(74) *Attorney, Agent, or Firm*—Keating & Bennett, LLP

(57) ABSTRACT

A valve mechanism drives an exhaust valve with a valve lifter and an exhaust camshaft. Oil is supplied to a journal surface of the camshaft and a bearing supporting the camshaft journal surface through an axial oil passage formed in the camshaft. The bearing is defined by a cam cap and a bearing main body. An oil collecting recess is defined between cam cap and the bearing main body. An auxiliary delivery passage extends from the oil collecting recess to a sidewall of the bearing that is located adjacent to the valve lifter. A guide wall is formed in the sidewall to lead oil from an opening of the auxiliary delivery passage to a part of the valve lifter that generates a striking noise in the absence of buffering oil.

10 Claims, 4 Drawing Sheets

ENGINE

CROSS-REFERENCE TO RELATED APPLICATIONS

This application is a U.S. National Phase of International Application No. PCT/JP2005/21367, filed Nov. 21, 2005, which is based upon Japanese Patent Application No. 2004-335549, filed Nov. 19, 2004, each of which is hereby incorporated by reference in its entirety.

BACKGROUND OF THE INVENTION

1. Field of the Invention

The present invention generally relates to an engine with a valve lifter provided between an intake or exhaust valve and a camshaft.

2. Description of the Related Art

Conventionally, as a valve actuating mechanism of a DOHC engine, there is a so-called direct-acting type with a valve lifter (i.e., tappet) installed between an intake or exhaust valve and a camshaft. The valve lifter is formed in a shape of a cylinder having a base. The generally cylindrical valve lifter is slidably positioned within a guide opening formed in a cylinder head. The guide opening is formed on an axis that is generally coaxial with a stem of the associated intake or exhaust valve. The valve lifter is installed in the guide opening with the base (i.e., the substantially closed end) facing a camshaft.

The camshaft (e.g., an intake camshaft or an exhaust camshaft) in the valve mechanism of this type comprises multiple cams such that an associated cam presses the valve lifter. The cam shaft also comprises multiple journal surfaces that are rotatably supported relative to the cylinder head with associated bearings. The journal surfaces can be disposed at both ends of the camshaft and can also be positioned adjacent to the cams.

The bearing that supports each journal surface can be formed integrally with the cylinder head and can comprise a bearing main body that supports the journal surface from below while a cam cap can be secured to the bearing main body for supporting the journal surface from above.

In the conventional engine equipped with the valve mechanism described above, oil is supplied to the journal surfaces through an oil passage formed in the camshaft. The oil passage comprises an axial passage formed in the camshaft that is joined to radial passages positioned proximate the journal surfaces. The radial passages typically open through the cam shaft toward the bearing. An oil pump supplies oil to the axial passage.

Oil leaking from the journal region lubricates the space between the valve lifter and the guide opening. Such a construction is disclosed in JP-A-Hei 9-79019. In some configurations, a bowl-shaped oil holder generally surrounds the upper circumference of the guide opening of the valve lifter in order to use the oil leaking from the bearing to lubricate the valve lifter, as shown in JP-Y-2531392.

SUMMARY OF THE INVENTION

When the passage through the camshaft is used to supply oil first to the journal surface and then to the guide opening, a striking noise may be generated from the valve lifter for a short time immediately after engine start. The striking noise is thought to be caused by (1) a clearance between the valve lifter and the guide opening (hereinafter referred to as an "engaging part of the valve lifter") and (2) the forces generated when the cam of the camshaft contacts the valve lifter during cam shaft rotation.

The engaging part of the valve lifter fills with oil while the engine operates. However, when the engine is not operated for a long time, the oil flows out of the opening. Accordingly, a gap is formed in the engaging part of the valve lifter that is not filled with oil after the engine stops operating for a sufficient period of time. In particular, the oil in the upper portion of a valve lifter tends to completely evacuate the opening when the valve lifter is positioned in an inclined orientation (inclined when viewed along an axis of the camshaft). When the engine starts with the evacuated space or gap formed adjacent the engaging part of the valve lifter as mentioned above, the valve lifter is moved toward the gap when a cam nose of the cam contacts the valve lifter. Therefore, as described above, the striking noise is thought to be generated as the valve lifter collides directly with the wall of the guide opening with no oil filling this region or as the upper part of the valve lifter suddenly inclines in the direction of the rotation of the camshaft about the upper end of the stem of the intake or exhaust valve immediately after a maximum lift. It is thought that because the oil flows into the engaging part of the valve lifter, the oil functions as a damper and the striking noise disappears after the engine is operated for a while. Moreover, as an outside temperature becomes cold and the viscosity of oil increases, it takes a longer time to supply the oil. As a result, the striking noise tends to continue for more extended periods during cold weather operation.

In recent years, to reduce the weight of an engine and to make the activation of a catalyst faster, sheet metal with a small thermal capacity has been used to make an exhaust manifold instead of using cast metal. When sheet metal is used to form an exhaust manifold, the manifold has been found to resonate with the striking noise of the valve lifter which amplifies the striking noise.

The lubricating apparatus described in JP-Y-2531392 has not corrected the striking noise issue. As the lubricating apparatus described in JP-Y-2531392 collects the oil leaking from the bearing in the bowl-shaped oil holder formed around the valve lifter, it takes a time to supply oil to the sliding part of the lifter, so that the striking noise immediately after an engine start is not eliminated.

Certain features, aspects and advantages of the present invention are designed to reduce or eliminate the striking noise caused by surface to surface contact within the cam actuation mechanism. Thus, an engine arranged and configured in accordance with certain features, aspects and advantages of the present invention has a valve mechanism for driving an intake valve and an exhaust valve by a valve lifter engaged in a guide opening in a freely slidable manner and a camshaft, an oil passage formed in the camshaft for supplying oil to a shaft opening between a journal and a bearing, in which an auxiliary oil passage has one end opened in an oil collecting part disposed in a part of the shaft opening and the other end opened in a side wall of a bearing adjacent to the valve lifter, and a guide wall formed on the side wall for leading oil from an exit of the auxiliary oil passage to a part of the valve lifter in which a striking noise is generated.

Thus, oil starts to flow out from the oil passage in the camshaft to the sidewall of the bearing through the auxiliary oil passage immediately after an engine start. The oil flows into the space formed in the engaging part of the valve lifter in which the striking noise is generated by way of the guide wall and fills this space. Because the oil filled in this space practically functions as a damper, the likelihood of a direct collision of the valve lifter on the surface of the opening wall of the guide opening for supporting the valve lifter is reduced or eliminated. As a result, striking noise is less likely to be generated from the engaging part of the valve lifter.

Because the oil collecting part formed in a part of the bearing opening of the bearing, the time taken by the oil to pass through the auxiliary oil passage and to flow out of the bearing immediately after an engine start is shortened relative to the time taken by the oil to lubricate the sliding part between the camshaft and the bearing and to flow out of the bearing. Therefore, the engine is less likely to generate the striking noise in the engaging part of the valve lifter during engine start while adopting an inexpensive structure in which the journal is lubricated by the oil passing through the oil passage in the camshaft so as to reduce the cost.

In one configuration, the bearing includes a bearing main body on the side of a cylinder head and a cam cap for supporting the camshaft in a freely rotatable manner in cooperation with the bearing main body, and the auxiliary oil passage is on an integral surface with the cam cap of the bearing main body and formed with a ditch bypassing a fixing bolt hole of the cam cap.

Thus, it is possible to form the auxiliary oil passage having a small cross-sectional area on an integrated surface of the bearing main body with the cam cap by milling or the like. In other words, because the passage is formed on the upper surface of the cylinder head (e.g., the external surface, which is on the side opposite to the cylinder block), it is easy to form the groove or ditch that at least partially defines the passage, which results in cost savings.

Moreover, when the fixing bolt hole of the cam cap is used for a part of the auxiliary oil passage, the passage capacity increases, and the oil supply immediately after an engine start is delayed. However, because the auxiliary oil passage is formed by bypassing the fixing bolt hole, oil can be supplied to the part generating the striking sound as promptly as possible.

In another configuration, the auxiliary oil passage is formed in a bearing for an exhaust camshaft, and an exhaust manifold is formed with a metal plate and equipped with a catalytic converter. Because the striking noise less likely to be generated from the engaging part of the valve lifter, it is possible to use a metal plate exhaust manifold, which is less desirable when the striking noise is generated. In other words, an exhaust manifold made of metal plate resonates easily and thus intensifies the striking noise.

The thermal capacity of a metal plate exhaust manifold is less than that of an exhaust manifold formed by casting. Therefore, because the metal plate exhaust manifold is used, the exhaust gas temperature drops less during engine start and the time following engine start. Consequently, after an engine start, it is possible for the catalytic converter to reach the activation temperature more quickly.

In a further configuration, the valve lifter is arranged in a inclining manner in which an end on the downstream side in the direction of slide with the cam on the top surface viewed from the direction of the camshaft is higher than an end on the opposite side, and a part generating the striking noise is an upper sliding part of the sliding part between the valve lifter and the guide opening.

In yet another configuration, cylinders of the engine are arranged in a V-shaped configuration. In the V-type engine, though the valve lifter positioned on the lower side in the direction of the inclination inclines relatively greatly due to the fact that the axial line of the cylinder inclines against the vertical direction, oil is supplied to the part of the valve lifter generating the striking noise immediately after an engine start. Therefore, a V-type engine can be providing that has a valve lifter less likely to generate a striking noise.

One aspect of an embodiment of the present invention relates to a valve mechanism for an engine. The valve mechanism drives at least one of an intake valve and an exhaust valve with a valve lifter engaged in a guide opening in a freely slidable manner and a camshaft. An oil passage is formed in the camshaft for supplying oil to a shaft opening between a journal and a bearing. An auxiliary oil passage has one end opened in an oil collecting part formed in a part of the shaft opening and the other end opened in a sidewall of the bearing adjacent to the valve lifter. A guide wall is formed on the sidewall and is provided for leading oil from an opening of the auxiliary oil passage to a part of the valve lifter in which a striking noise is generated.

Another aspect of an embodiment of the present invention relates to an engine comprising a valve. The valve comprises a stem. The stem is positioned within a valve lifter. The valve lifter is positioned within a guide opening defined within a cylinder head. The cylinder head comprises a bearing main body. A cam cap is coupled to the bearing main body. A camshaft comprises a journal surface and the journal surface is positioned between the cam cap and the bearing main body. The camshaft defines an axial oil passage extending axially through at least a portion of the camshaft. The camshaft also defines a radial oil passage extending radially through at least a portion of the camshaft. The radial oil passage is fluidly connected to the axial oil passage. The radial passage extends through the journal surface. An oil collecting recess is defined between the bearing main body and the cam cap. At least one delivery passage also is defined between the bearing main body and the cam cap. The at least one delivery passage is in fluid communication with the oil collecting recess. The guide opening comprises a guide surface that extends from the at least one delivery passage toward the valve lifter such that oil can be directed to a gap defined between a portion of the valve lifter and the guide opening.

BRIEF DESCRIPTION OF THE DRAWINGS

These and other features, aspects and advantages of the present invention will now be described with reference to the drawings of a preferred embodiment, which embodiment is intended to illustrate and not to limit the invention. The drawings comprise 5 figures.

DETAILED DESCRIPTION OF THE PREFERRED EMBODIMENT

Figure 1:
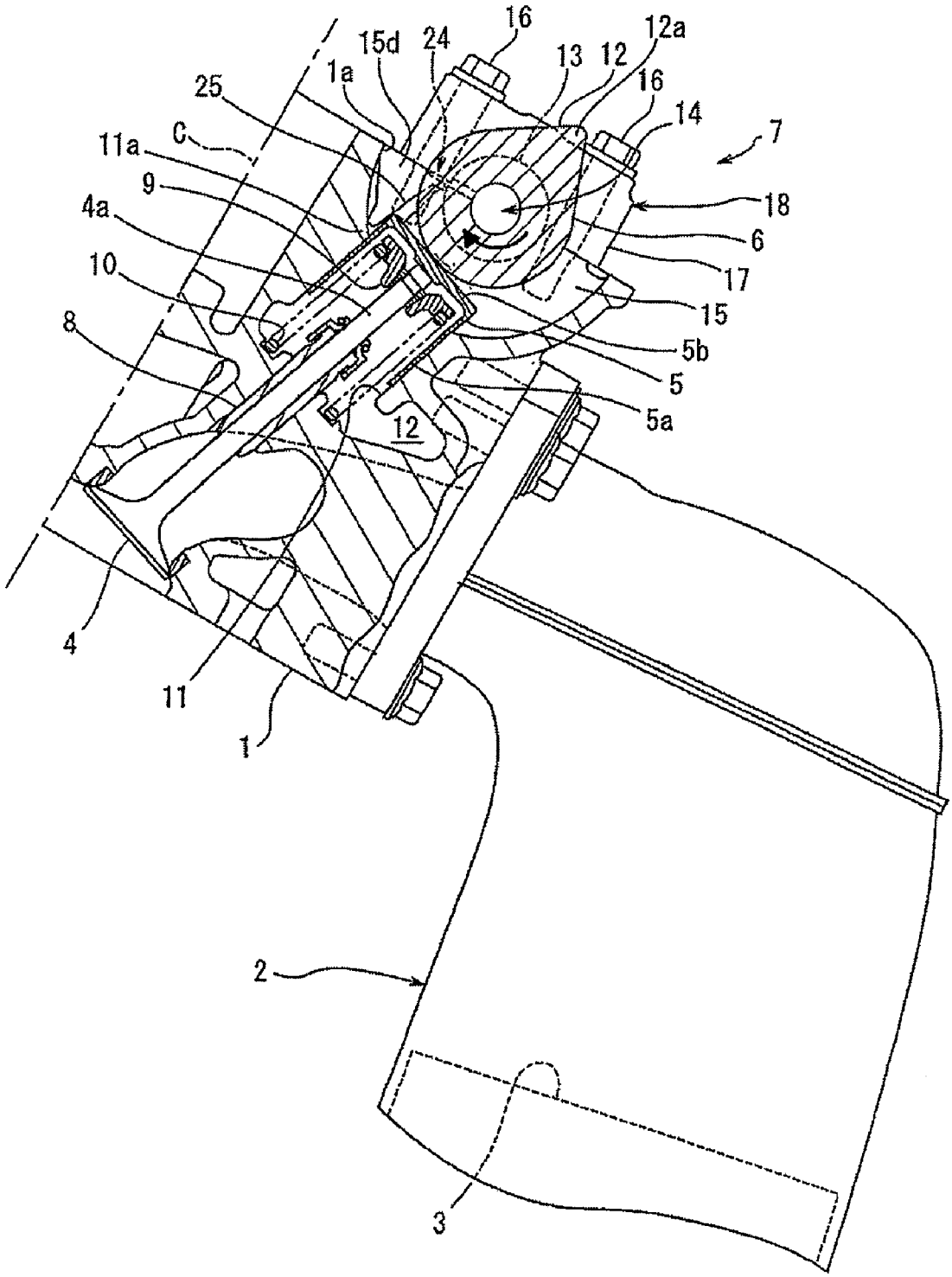
FIG. 1 shows a cross-sectional view illustrating a magnified view of an exhaust valve driving part of the engine arranged and configured in accordance with certain features, aspects and advantages of the present invention.

The following description explains an embodiment of the present invention with reference to accompanying drawings. Engines arranged and configured in accordance with certain features, aspects and advantages of the present invention can be used for vehicles, such as, but not limited to, cars and motorcycles.

In these drawings, number 1 indicates a cylinder head of an engine for a passenger car according to the embodiment. The cylinder head 1 is attached to a top of a cylinder block (not shown in the drawings) and equipped with a head cover (not shown in the drawings) on the top end.

The engine equipped with the cylinder head 1 is a parallel V-type engine, a crankshaft (not shown in the drawings) extends in the vehicle width direction, and the engine is installed in an engine compartment (not shown in the drawings) with transverse rows of cylinders being positioned to the front and to the rear of the engine in the transverse direction of the vehicle body. The engine has an intake camshaft (not shown in the drawings) of each cylinder row arranged on an inner side of the V bank and an exhaust camshaft arranged on an outer side.

The cylinder head 1 shown in FIG. 1 shows members around the exhaust camshaft in the front part of the cylinder row positioned on the front side of the vehicle body. The cylinder row on the front side of the vehicle body is arranged so that an axial line C of the cylinder row (see FIG. 1) inclines upward and forward and the axial line of the cylinder row on the rear side of the vehicle body (not shown in the drawings) inclines upward and rearward. In FIG. 1, the vertical direction of the drawing is the plumb line, and the right direction is the front side of the vehicle body.

The cylinder head 1 of the cylinder row on the front side of the vehicle body is equipped with an exhaust manifold 2 extending downward in front of the engine. The exhaust manifold 2 is formed with a metal plate molded in a certain shape by pressing and is equipped with a catalytic converter 3.

The cylinder head 1 is equipped with a valve mechanism 7 having a structure for pressing an exhaust valve 4 with a valve lifter 5 and an exhaust camshaft 6 as shown in FIG. 1. The valve mechanism 7 preferably also has a structure in which an intake valve (not shown in the drawings) is driven by a valve lifter and an intake camshaft (not shown in the drawings). Two exhaust valves 4 and two intake valves are provided in each cylinder.

Each of these intake and exhaust valves is supported with a valve stem guide 8 in a freely slidable manner in the cylinder head 1, and a retainer 9 is attached to the end. Between the retainer 9 and the cylinder head 1, a valve spring 10 is inserted. The end surface (the top end surface) of a stem 4*a* of the intake valve or the exhaust valve 4 is in contact with the inner end surface of the valve lifter 5 described below.

As shown in FIG. 1, the valve lifter 5 is formed in a shape of cylinder with a side wall 5*a* and a base 5*b*. The valve lifter 5 is inserted in a guide opening 11 of the cylinder head 1 in a freely slidable manner. The guide opening 11 is formed in a position on an axis that is generally coaxial with the stem 4*a* of an intake or exhaust valve and has an opening that slants generally upward. Below the guide opening 11 in the cylinder head 1, an oil chamber 12 is formed for leading oil to a drain passage (not shown in the drawings).

The valve lifter 5 is positioned inside of the guide opening 11 with the outer end surface of a base wall 5*b* facing the camshaft and the inner end surface of the base wall 5*b* in contact with the upper end surface of the stem 4*a* of the intake or exhaust valve. Between the valve lifter 5 and the wall surface of the guide opening 11, clearance is provided.

Figure 2:
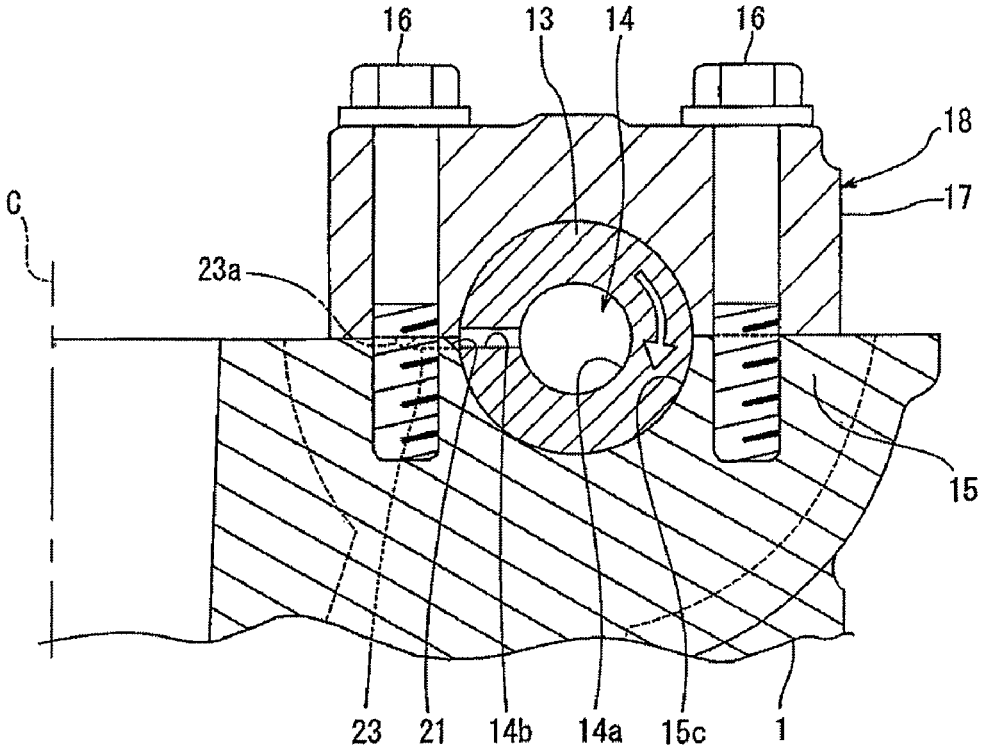
FIG. 2 is a cross-sectional view illustrating a magnified view of a bearing part of an exhaust camshaft.
Figure 3:
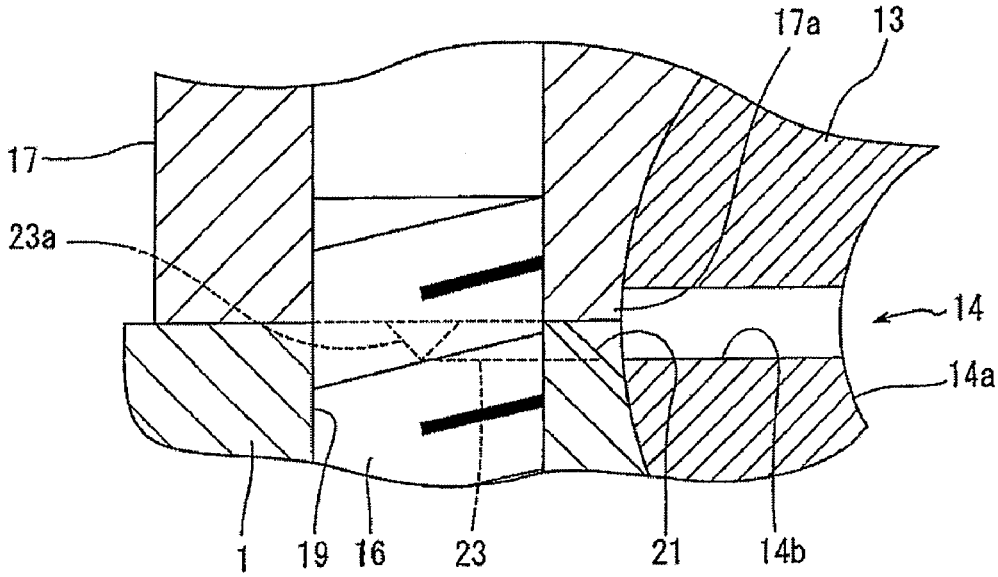
FIG. 3 is an enlarged cross-sectional view of a portion of FIG. 2.
Figure 5:
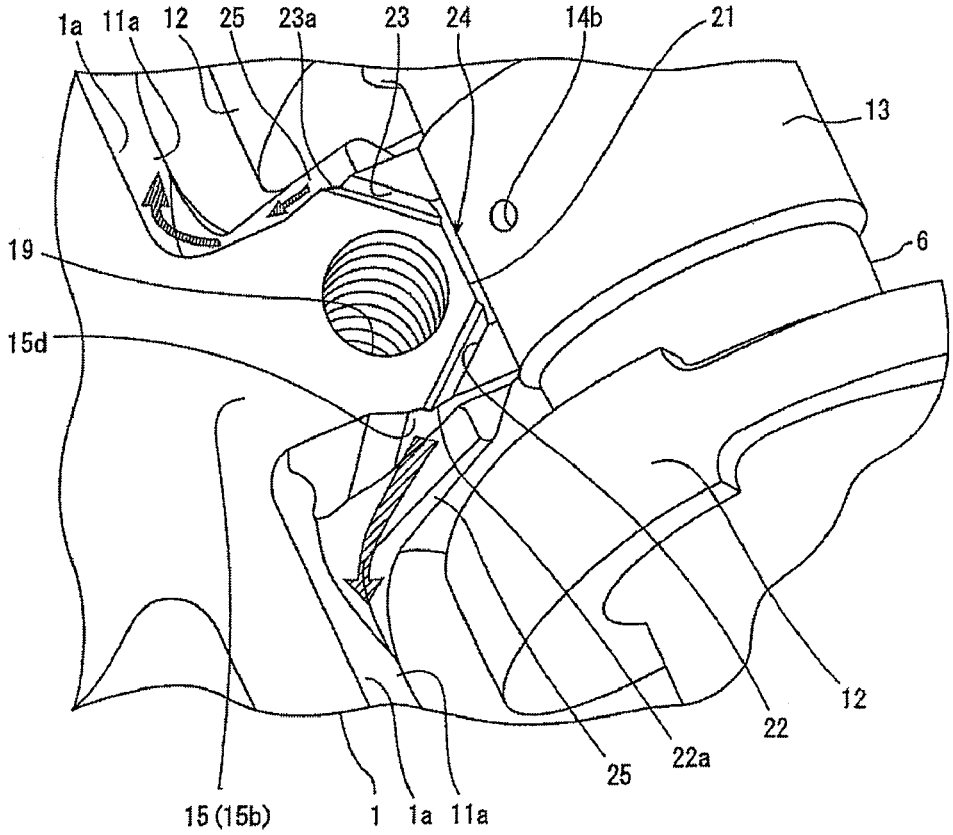
FIG. 5 is an oblique view illustrating a magnified view of a journal and an exhaust camshaft.

As shown in FIG. 1, FIG. 2, and FIG. 5, the exhaust camshaft 6 is integrally formed in a manner in which a cam 12 for pressing the valve lifter 5 and a journal 13 supported by the cylinder head 1 are alternatingly arranged in the axial direction. The exhaust camshaft 6 preferably rotates clockwise in FIG. 1. Inside the exhaust camshaft 6, an oil passage 14 for supplying the oil discharged from an oil pump (not shown in the drawings) is formed. As shown in FIG. 2 and FIG. 3, the oil passage 14 comprises a main oil passage 14*a* extending in the axial direction along a shaft center of the exhaust camshaft 6 and a radial oil passage 14*b* extending radially from the main oil passage 14*a* toward the outside.

One end of the main oil passage 14*a* is connected with an oil supply opening (not shown in the drawings) of the cylinder head 1, and the other end is closed. The radial oil passage 14*b* is formed in a location corresponding to the journal 13 respectively and opens through the outer circumferential surface of the journal 13.

As shown in FIG. 2 and FIG. 3, the journal 13 is held between the bearing main body 15, which can be formed integrally with the cylinder head 1, and a bearing 18, which comprises a cam cap 17 attached with a fixing bolt 16 to the upper surface of the bearing main body 15. Thus, the journal 13 is supported in a freely rotatable manner. The radial oil passage 14*b* of the oil passage 14 formed inside the journal 13 opens through the surface of the journal 13 at a location adjacent the inner surfaces of the bearing main body 15 and the cam cap 17.

Figure 4:
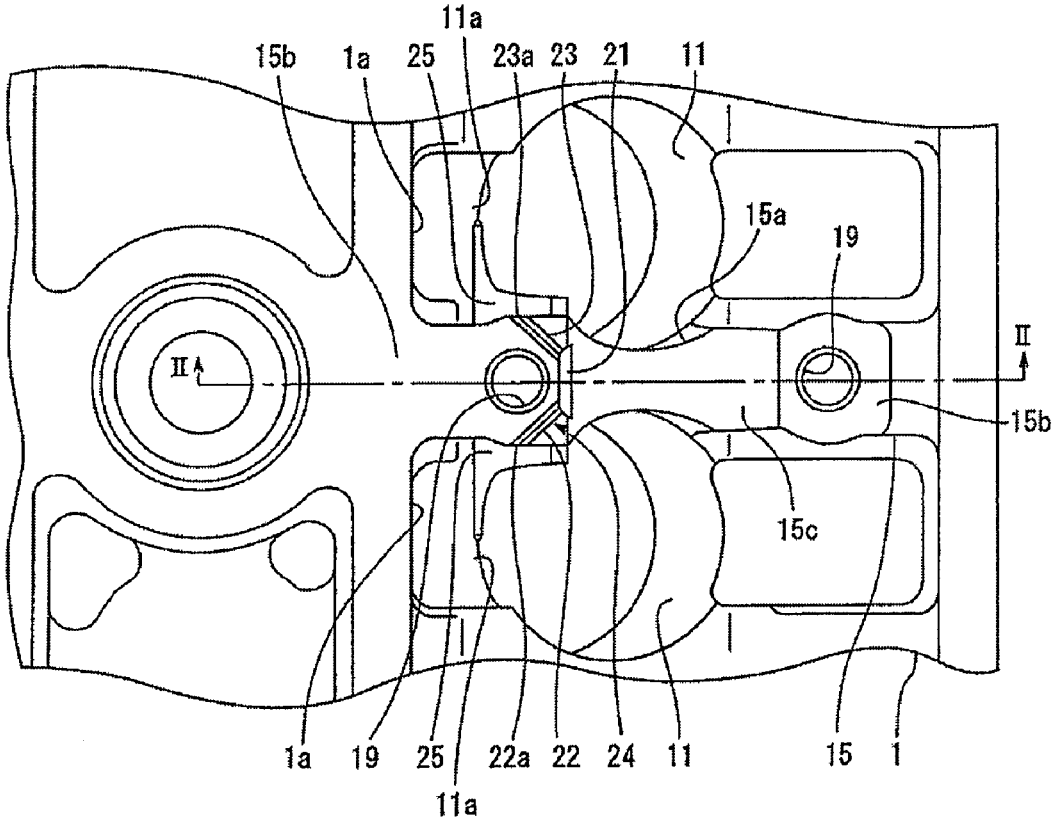
FIG. 4 is a plan view of a bearing main body for an exhaust camshaft of a cylinder head and showing a position of the cross-section of FIG. 2 with the line II-II.

The bearing 18 preferably is attached to both ends (not shown in the drawings) of the exhaust camshaft 6 and in the part positioned between guide openings 11 and 11 for the valve lifter formed in two places of one cylinder as shown in FIG. 4. As shown in FIG. 4, the bearing main body 15 of the bearing 18 positioned between the two guide openings 11, 11 preferably has concave surfaces 15*a* formed on both ends for avoiding interference of the time when the valve lifter 5 is inserted into the guide opening 11.

On an integrated surface 15*b* (shown in two places in FIG. 4) in which the cam cap 17 abuts with the bearing main body 15, a fixing bolt hole 19 with which the cam cap 17 is secured with the fixing bolt 16 is formed as shown in FIG. 3 to FIG. 5. In addition, in the illustrated embodiment, an oil collecting part 21 that opens to the inside of the bearing opening of the bearing 18 and an auxiliary oil passage 24 having first and second concave ditches 22 and 23, which define delivery passages, connected with the oil collecting part 21 are formed on the surface 15*b*.

The oil collecting part or recess 21 preferably extends in the direction of the axial line of the exhaust camshaft 6 (e.g., up and down in FIG. 4) within the range in which the integrated surface 15*b* is formed as shown in FIG. 4. The oil collecting part 21 preferably is formed in a shape of a so-called C chamfering so as to reach an inner circumference 15*c* of the shaft opening in which the journal 13 rotates as shown in FIG. 3. As described above, because the oil collecting part 21 is formed in the shaft opening of the bearing 18, an integrated wall 17*a* of the cam cap 17 protrudes in a shape of an eaves from the oil collecting part 21 on the downstream side in the direction of the rotation of the exhaust camshaft 6. Therefore, when the cam shaft 6 rotates in the bearing 18, the oil coming through the radial oil passage 14*b* is actively collected into the oil collecting part 21 through the integrated wall 17*a*, which protrudes over the oil collecting part 21 and the integrated wall 17*a* directs the oil into the oil collecting part 21.

In the illustrated embodiment, the first concave ditch 22 and the second concave ditch 23 (see FIG. 4) are formed to have a cross section in a shape of the letter V opened toward the cam cap 17 and are formed to extend obliquely from the oil collecting part 21 on both sides of the fixing bolt hole 19 by bypassing the fixing bolt hole 19 as shown in FIG. 4. One end of each first and second concave ditches 22 and 23 is opened to the oil collecting part 21, and the other end is opened to a side wall 15*d* of the bearing main body 15 (see FIG. 1 and FIG. 5).

The first and second concave ditches 22 and 23 extend toward a vertical wall 1*a* of the cylinder head 1 (see FIG. 1 and FIG. 5) from the oil collecting part 21 in plan view. The vertical wall 1*a* at least partially forms a space in which the cam 12 on the exhaust camshaft 6 rotates and extends upward from a part on the left side of and relatively higher than the valve lifter 5 on an opening edge of the guide opening 11, making an arc in the cross-sectional view in FIG. 1.

Openings 22*a* and 23*a* on the other ends of the first and second concave ditches 22 and 23 are positioned higher than a guide wall 25 that protrudes from the side wall 15*d* of the bearing main body 15 as shown in FIG. 4 and FIG. 5. As shown in FIG. 1, the guide wall 25 extends downward at an angle, gradually coming closer to the axial line C of the cylinder. As shown in FIG. 1, the bottom end of the illustrated guide wall 25 generally to the uppermost edge of the inclining guide opening 11.

The guide opening 11 shown in FIG. 1 is formed in a manner in which the center line (the axial line of the valve lifter 5) inclines rightward in the drawing. In other words, the guide opening 11 is formed so that a part on a downstream side (the left side in the drawing) in the direction of the rotation of the exhaust camshaft 6 is higher. As shown in FIG. 1, the valve lifter 5 inserted in the guide opening 11 also is arranged in an inclining manner. Thus, the downstream edge, when viewed along the path of cam movement along the top of the valve lifter 5, is higher than the upstream edge.

As explained above, where the valve lifter 5 slides on the inclined guide opening 11, a space may be formed when oil flows down while the engine is not operated for a long time. Such a phenomena is most likely to occur in the uppermost portion of the guide opening 11. Thus, this portion of the guide opening 11 is a part in which the striking noise is generated as explained above. The portion most likely generating the striking noise is indicated with a symbol 11*a* in FIG. 1, FIG. 4, and FIG. 5.

The oil collecting part 21 and the auxiliary oil passage 24, including the first and second ditches 22 and 23, define an opening extending from the sliding and contacting part of the bearing 18 and the exhaust camshaft 6 when the cam cap 17 is attached to the bearing main body 15 and get connected to the oil passage 14 in the exhaust camshaft 6 when the engine is operated. Consequently, when the engine is operated, the oil passes through the oil collecting part 21 and the auxiliary oil passage 24 and flows out of both side walls 15*d* of the bearing main body 15. The oil is lead to the part 11*a* generating the striking noise in the guide opening 11 along the guide wall 25, enters the space between the valve lifter 5 and the guide opening 11, and lubricates the space. Therefore, oil passes the oil passage 14 in the exhaust camshaft 6 and the auxiliary oil passage 24 in the bearing 18 and flows out to the side wall 15*d* immediately after an engine start, the oil is led by the guide wall 25 to the part 11*a* generating the striking noise of the valve lifter, and the oil flows into the space formed between the valve lifter 5 and the guide opening 11.

The oil filled in the space functions practically as a damper when the valve lifter 5 moves toward the wall of the guide opening 11. Therefore, the oil reduces or eliminates the likelihood that the valve lifter 5 will forcefully contact the surface of the opening wall of the guide opening 11 as a result of movement caused the rotation of the camshaft of the direction in which the cam slides over the valve lifter. In other words, the oil reduces or eliminates the likelihood that the upper part of the valve lifter 5 will directly collide with the surface of the opening wall when the valve lifter 5 inclines about the upper end of the stem 4*a* of the exhaust valve 4 as a result of the exhaust camshaft 6 coming into contact with the valve lifter 5 immediately after a maximum lift of the valve 4. Thus, the likelihood of the engine producing the striking noise is greatly reduced or eliminated.

In addition, the time required for the oil to come in to the oil collecting part 21, to pass through the auxiliary oil passage 24, and to flow out of the bearing 18 immediately after an engine start is shortened when compared to the time required for the oil to lubricate the sliding part between the exhaust camshaft 6 and the bearing 18 and to flow out of the bearing 18. In addition, the oil having passed through the auxiliary oil passage 24 and flowing out of the bearing 18 is directly led to the part 11*a* generating the striking noise along the guide wall 25. Therefore, the illustrated engine is less likely to generate the striking noise from the time immediately after an engine start. Moreover, the illustrated configuration is very cost effective to achieve. Specifically, the illustrated engine can collect oil efficiently by members between the oil passage 14 and the oil collecting part 21 and can lead the oil to the auxiliary oil passage 24 even if the viscosity of the oil is high due to an extremely low ambient temperature. Therefore, because the guide wall 25 can lead the oil that leaks out of the auxiliary oil passage 24 to the part 11*a* generating the striking noise, the engine is less likely to produce the striking noise.

When a certain time has passed after the engine has started, because the viscosity of oil decreases by warm-up, the amount and the speed of the oil flowing out of the opening of the auxiliary oil passage 24 increases. In this state, some portion of the oil flowing out of the auxiliary oil passage 24 flows along the guide wall 25, and another portion jumps over the guide wall 25 and directly adheres to the vertical wall 1*a* of the cylinder head 1, flows along the vertical wall 1*a*, and flows down into the edge of the opening. In this case, it is possible to supply a sufficient amount of oil to the sliding part of the valve lifter 5.

Advantageously, the oil collecting part 21 and the auxiliary oil passage 24 are formed by the first and second concave ditches 22 and 23, which are recessed into the bearing main body 15 of the cylinder head 1. Therefore, the oil collecting part 21 and the auxiliary oil passage 24 can be easily formed by a material removal operation, such as milling or cutting. In some configurations, the auxiliary oil passage 24 can be formed on the integrated surface with the cam cap 17 and also can be formed with a hole in the bearing main body 15 by a drill or the like.

Because the illustrated engine is less likely to produce the striking noise generated from the engaging part of the exhaust valve lifter 5, it is possible to install a metal plate exhaust manifold 2. Therefore, the engine can be made lighter and the thermal capacity of the exhaust manifold 2 can be decreased in comparison with an engine using a cast exhaust manifold. The decreased thermal capacity results in less temperature drop of the exhaust gas and it is possible for the catalytic converter 3 to reach the activation temperature more quickly after an engine start.

The embodiment above shows an example where the auxiliary oil passage 24 is formed in the bearing main body 15 of the cylinder head 1. However, the oil collecting part 21 and the first and second concave ditches 22 and 23 can be formed in the cam cap 17. When this structure is used, because it is not necessary to consider the attachment direction when the cam cap 17 is attached to the bearing main body 15 by forming the oil collecting part 21 and the first and second concave ditches 22 and 23 on both sides in the longitudinal direction of the cam cap 17, assembly can be done easily. Even when this structure is used, the guide wall 25 preferably is formed on the downstream side in the direction of the rotation of the exhaust camshaft 6 as described in the above embodiment.

When the structure, in which the oil collecting part 21 and the first and second concave ditches 22 and 23 are formed in the cam cap 17, is used, the likelihood of the striking noise can be reduced by replacing the cam cap 17, which includes the part generating the striking noise, with the cam cap disclosed herein. Therefore, for example, when striking noise occurs due to wear, the striking noise can addressed without necessarily removing the cylinder head 1 from the cylinder block.

The auxiliary oil passage 24 in the illustrated configuration bypasses the fixing bolt hole 19 of the fixing bolt 16 for the cam cap installation. Therefore, it is easy to clean the inside of the auxiliary oil passage 24 with a high-pressure cleaning solution after the inner circumference of the bearing 18 is machined while the cam cap 17 is installed on the bearing main body 15 by the fixing bolt 16. When the auxiliary oil passage 24 passes through the fixing bolt hole 19, because the cuttings generated by the finishing machining enters the bolt hole 19, it is necessary to clean the inside of the bolt hole 19 by removing the cam cap 17.

The embodiment above shows an example in which the auxiliary oil passage 24 is formed in the bearing 18 of the exhaust camshaft. However, the present invention is not limited to this example. The auxiliary oil passage 24 can be formed in the bearing for the intake camshaft or can be formed in the cylinder head in the cylinder row on the rear side of the vehicle body. In addition, the engine according to the present invention is not limited to a V-type but can be also applied to an engine for a vehicle other than a passenger car such as an engine for a motor cycle.

Although the present invention has been described in terms of a certain embodiment, other embodiments apparent to those of ordinary skill in the art also are within the scope of this invention. Thus, various changes and modifications may be made without departing from the spirit and scope of the invention. For instance, various components may be repositioned as desired. Moreover, not all of the features, aspects and advantages are necessarily required to practice the present invention. Accordingly, the scope of the present invention is intended to be defined only by the claims that follow.

What is claimed is:

1. An engine comprising a valve, said valve comprising a stem, said stem being positioned within a valve lifter, said valve lifter being positioned within a guide opening defined within a cylinder head, said cylinder head comprising a bearing main body, a cam cap coupled to the bearing main body, a cam shaft comprising a journal surface and said journal surface being positioned between said cam cap and said bearing main body, said cam shaft defining an axial oil passage extending axially through at least a portion of said cam shaft, said cam shaft also defining a radial oil passage extending radially through at least a portion of said cam shaft, said radial oil passage being fluidly connected to said axial oil passage, said radial passage extending through said journal surface, an oil collecting recess being defined between said bearing main body and said cam cap, at least one delivery passage also being defined between said bearing main body and said cam cap, said at least one delivery passage being in fluid communication with said oil collecting recess, said guide opening comprising a guide surface extending from said at least one delivery passage toward said valve lifter such that oil can be directed to a gap defined between a portion of said valve lifter and said guide opening.

2. The engine of claim 1, wherein said oil collecting recess is defined in said bearing main body.

3. The engine of claim 1, wherein said at least one delivery passage is defined in said bearing main body.

4. The engine of claim 1, wherein a portion of said cam cap overhangs said oil collecting recess.

5. The engine of claim 1, wherein said at least one delivery passage does not intersect a bolt hole used to secure said cam cap to said bearing main body.

6. The engine of claim 1 further comprising a metal plate exhaust manifold that is connected to a catalytic converter.

7. The engine of claim 1, wherein the valve lifter translates along an axis and said axis is inclined relative to a plumb line.

8. The engine of claim 7, wherein the cam shaft comprises a cam nose that slides over a portion of said valve lifter, said cam nose sliding from a first portion to a second portion, said second portion being vertically higher than said first portion due to said inclined axis.

9. The engine of claim 8, wherein said guide surface is disposed proximate said second portion.

10. The engine of claim 1, wherein said engine comprises inclined cylinders.

* * * * *